US008091515B2

(12) United States Patent
Rigamonti

(10) Patent No.: US 8,091,515 B2
(45) Date of Patent: Jan. 10, 2012

(54) HEAT EXCHANGER FOR HOT AIR GENERATOR AND BOILER

(76) Inventor: Angelo Rigamonti, Pessano Con Bornago (IT)

( * ) Notice: Subject to any disclaimer, the term of this patent is extended or adjusted under 35 U.S.C. 154(b) by 717 days.

(21) Appl. No.: 12/223,922

(22) PCT Filed: Oct. 11, 2006

(86) PCT No.: PCT/EP2006/067252

§ 371 (c)(1),
(2), (4) Date: Aug. 13, 2008

(87) PCT Pub. No.: WO2007/093231

PCT Pub. Date: Aug. 23, 2007

(65) Prior Publication Data

US 2009/0044931 A1 Feb. 19, 2009

(51) Int. Cl.
*F22B 23/06* (2006.01)

(52) U.S. Cl. ..... 122/367.1; 122/209.1; 165/153

(58) Field of Classification Search ..... 122/31.1, 122/33, 37, 68, 367.1, 406.3, 209.1; 165/139, 165/152, 153, 166, 167
See application file for complete search history.

(56) References Cited

U.S. PATENT DOCUMENTS

| | | | | |
|---|---|---|---|---|
| 1,339,813 | A | 5/1920 | Dyckman | |
| 4,081,025 | A * | 3/1978 | Donaldson | 165/140 |
| 4,470,455 | A | 9/1984 | Sacca | |
| 4,915,163 | A * | 4/1990 | Matsunaga et al. | 165/153 |
| 5,099,913 | A * | 3/1992 | Kadle | 165/147 |
| 5,613,553 | A * | 3/1997 | Hong | 165/140 |
| 5,720,341 | A * | 2/1998 | Watanabe et al. | 165/135 |
| 5,794,691 | A * | 8/1998 | Evans et al. | 165/153 |
| 6,378,603 | B1 * | 4/2002 | Shimoya et al. | 165/153 |
| 6,918,433 | B2 * | 7/2005 | Kontu | 165/160 |
| 6,953,009 | B2 * | 10/2005 | Reinke et al. | 122/31.1 |
| 7,063,047 | B2 * | 6/2006 | Reinke et al. | 122/31.1 |
| 7,108,053 | B2 * | 9/2006 | Brenner et al. | 165/166 |
| 7,413,003 | B2 * | 8/2008 | Oh et al. | 165/153 |
| 2002/0179291 | A1 * | 12/2002 | Abate et al. | 165/153 |
| 2003/0024696 | A1 * | 2/2003 | Haplau-Colan et al. | 165/153 |
| 2004/0035564 | A1 * | 2/2004 | Park et al. | 165/153 |
| 2007/0158055 | A1 * | 7/2007 | Yeh et al. | 165/153 |

FOREIGN PATENT DOCUMENTS

| | | |
|---|---|---|
| JP | 06-074678 | 3/1994 |
| WO | 99/30099 | 6/1999 |

OTHER PUBLICATIONS

International Search Report mailed Jan. 19, 2007 for International Application No. PCT/EP2006/067252. International Preliminary Report on Patentability mailed May 13, 2008 for International Application No. PCT/EP2006/067252.
Written Opinion of the International Searching Authority mailed Jan. 19, 2007 for International Application No. PCT/EP2006/067252.

* cited by examiner

*Primary Examiner* — Gregory A Wilson
(74) *Attorney, Agent, or Firm* — Wenderoth, Lind & Ponack, L.L.P.

(57) ABSTRACT

A heat exchanger includes at least one exchanger module, including a combustion chamber for the generation of an exchange fluid, a slotted wall for the passage of the exchange fluid and an expulsion chamber for the exchange fluid provided with a discharge flue. Said exchanger module is formed by a pair of basic elements, each of which contributes to form a part of said combustion chamber, a part of said slotted wall and a part of said expulsion chamber. The basic elements are reciprocally connected in facing position so as to form a single block. The present invention facilitates the assembly operations for a heat exchanger, to obtain modular exchangers and to reduce the structural elements of the exchangers.

18 Claims, 10 Drawing Sheets

HEAT EXCHANGER FOR HOT AIR GENERATOR AND BOILER

BACKGROUND OF THE INVENTION

The present invention relates to a heat exchanger for hot air generator and boiler.

Heat exchangers are devices that are normally used in industrial or domestic systems to modify the temperature or the state of fluids, e.g. air or water. The principle they are based on is the transmission by conduction of heat through a wall or a membrane, so that two fluids tend to reduce the mutual temperature difference by generating a thermal flow that tends to warm the colder fluid and to cool the warmer fluid. The temperatures obtained at the end of such process vary depending on the physical and chemical characteristics of the fluids (air, water or others) and of the wall or membrane (having high or low thermal conductivity), on the geometry of the membrane surface (a larger slotted wall generally leads to a greater amount of heat exchanged) and on the flow characteristics (forced or natural convection, presence of turbulences).

In this way, the temperature of a fluid ("working fluid") may be modified by forcing the heat exchange with another fluid ("exchange fluid"), a large amount of which is available at a temperature suitable to bring the working fluid to the requested temperature. When the heat exchange is over, the working fluid reaches the requested temperature, whereas the exhausted exchange fluid no longer allows the requested heat exchange and must therefore be expelled.

For example, if the working fluid needs to be heated, a heat exchange with fumes obtained by combustion from a burner may be carried out. To put such a process into practice, it is possible to use a heat exchanger comprised of:

- a combustion chamber to generate high temperature fumes;
- a tube bundle for the thermal exchange between the fumes and the working fluid;
- a collection chamber for the exhausted fumes;
- connectors between the combustion chamber and the tube bundle and between the latter and the fume collection chamber;
- a discharge flue in connection with the fume collection chamber.

More generally, a generic heat exchanger comprises:

- a combustion chamber;
- a slotted wall between the exchange fluid and the working fluid;
- an expulsion chamber for the exhausted exchange fluid;
- connector elements between the various components.

Even though the physical principle the heat exchange technique is based on is very simple, there occurs a great difficulty in assembling the exchanger, because the constituent elements and the connector elements are numerous and different; their construction requires the use of a lot of machinery and equipment and of skilled labour.

Moreover, the need to achieve high efficiency in terms of exchanged heat in relation to the size of the heat exchanger leads to force winding paths for the exchange fluid, by inserting devices adapted to obtain a turbulent flow, which further increase the complexity of the heat exchangers.

Finally, because of the heat exchanger assembling complexity, it is rather difficult to modify the exchangers once these have already been constructed.

BRIEF SUMMARY OF THE INVENTION

It is the object of the present invention to obtain a heat exchanger which overcomes the above-discussed construction problems.

According to the invention such an object is achieved by a heat exchanger comprised of at least one exchanger module comprising a combustion chamber for the generation of an exchange fluid, a slotted wall for the passage of the exchange fluid and an exchange fluid expulsion chamber provided with a discharge flue, characterised in that said exchanger module is formed by a pair of basic elements, each of which contributes to form a part of said combustion chamber, a part of said slotted wall and a part of said expulsion chamber, such basic elements being reciprocally connected in facing position so as to form a single block.

Specifically, said slotted wall provides for winding paths constructed by tilted slots intended to increase the flow voracity, and therefore the thermal exchange.

A further aid to the formation of turbulences is obtained by conveying the course of the exchange fluid in a descending direction.

Likewise, the exchange fluid is formed in the combustion chamber, it enters the slotted wall and it passes in the expulsion chamber, from which it exits through the discharge flue.

The construction process of an exchanger according to the invention may comprise three processing steps:

- a construction step for said basic elements from sheet elements;
- a construction step for said exchanger modules from said basic elements;
- an assembling step for said heat exchanger from said exchanger modules.

Said construction step for said basic elements may comprise the mechanical deformation of sheet elements, through processes such as drawing, and the removal of parts of such a sheet.

Said construction step for said exchanger modules may comprise the connection of basic elements, e.g. obtained by laser welding, and the removal of parts of such basic elements.

Said assembling step for an exchanger according to the invention may comprise the connection of several exchanger modules, e.g. obtained by laser welding, so that such exchanger modules are connected in a cascade. Finally, to said exchanger there must be applied a burner that generates an exchange fluid by burning within the combustion chamber.

It may be noted that the construction of an exchanger is particularly simple. Moreover, the addition and the removal of further exchanger modules is facilitated, rendering the modification of size, features and potential of said exchanger easy.

These and other features of the present invention will become more apparent from the following detailed description of an embodiment thereof, which is illustrated by no way of limitation in the accompanying drawings, in which:

DETAILED DESCRIPTION OF THE INVENTION

Figure 1:
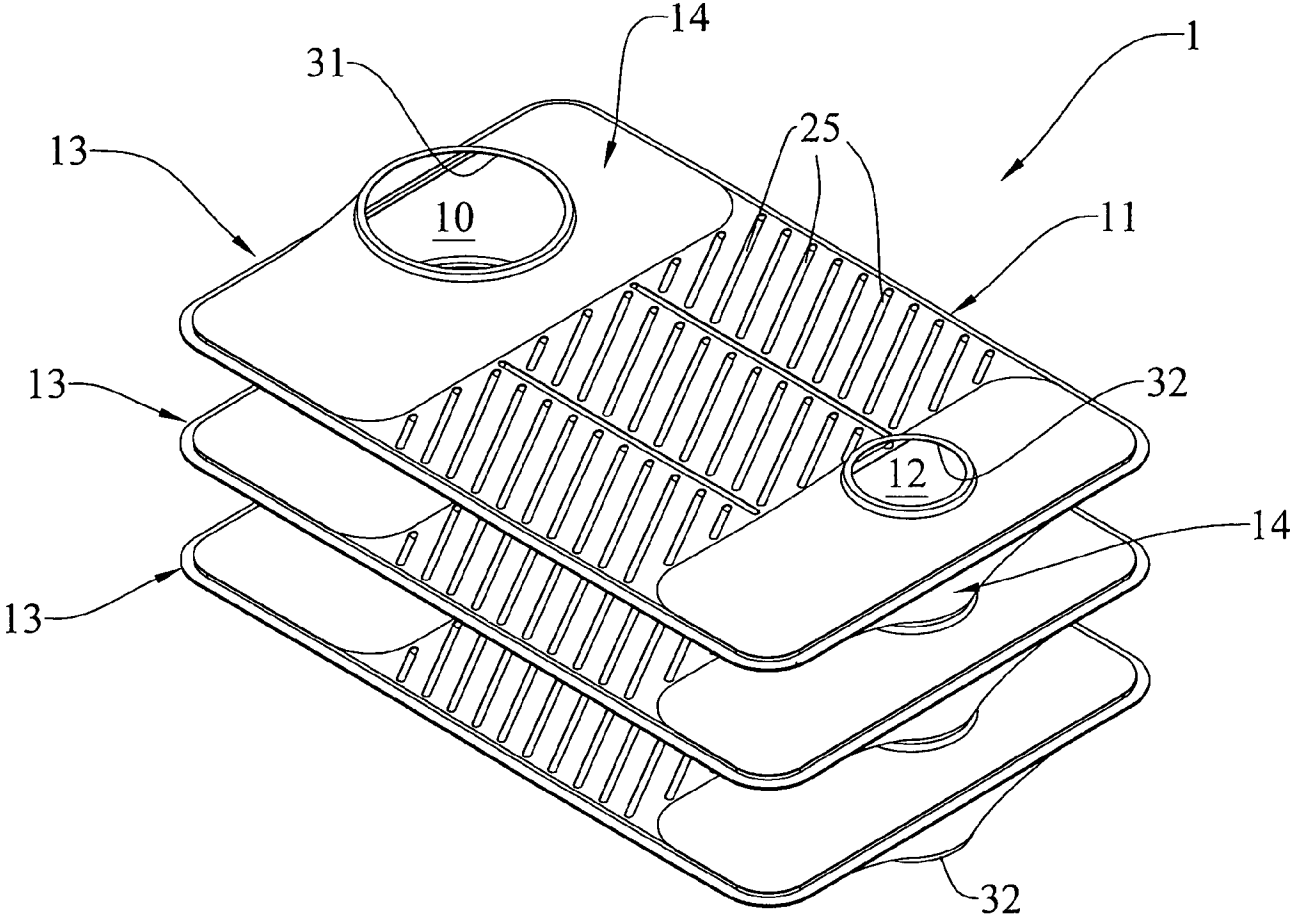
FIG. 1 shows a perspective view of a heat exchanger according to an embodiment of the present invention.
Figure 2:
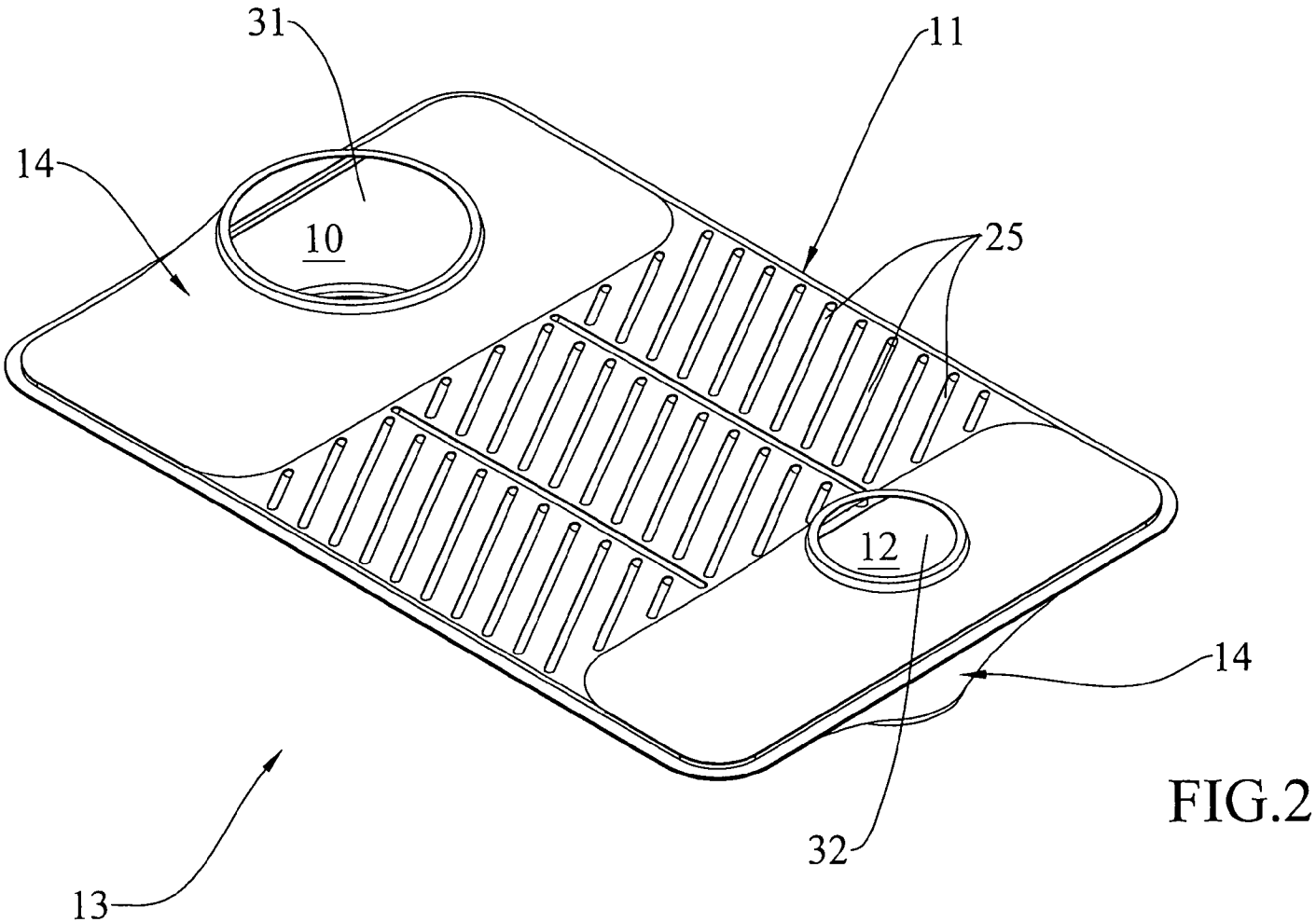
FIG. 2 shows a perspective view of an exchanger module constituting the embodiment of FIG. 1.

With reference to FIG. 1, a heat exchanger 1, comprised of three reciprocally connected exchanger modules 13, may be observed, where each module 13 (FIG. 2) is subdivided in a combustion chamber 10, a slotted wall 11 and an expulsion chamber 12. Said exchanger module is comprised of two basic elements 14 reciprocally attached in facing position.

Figure 3:
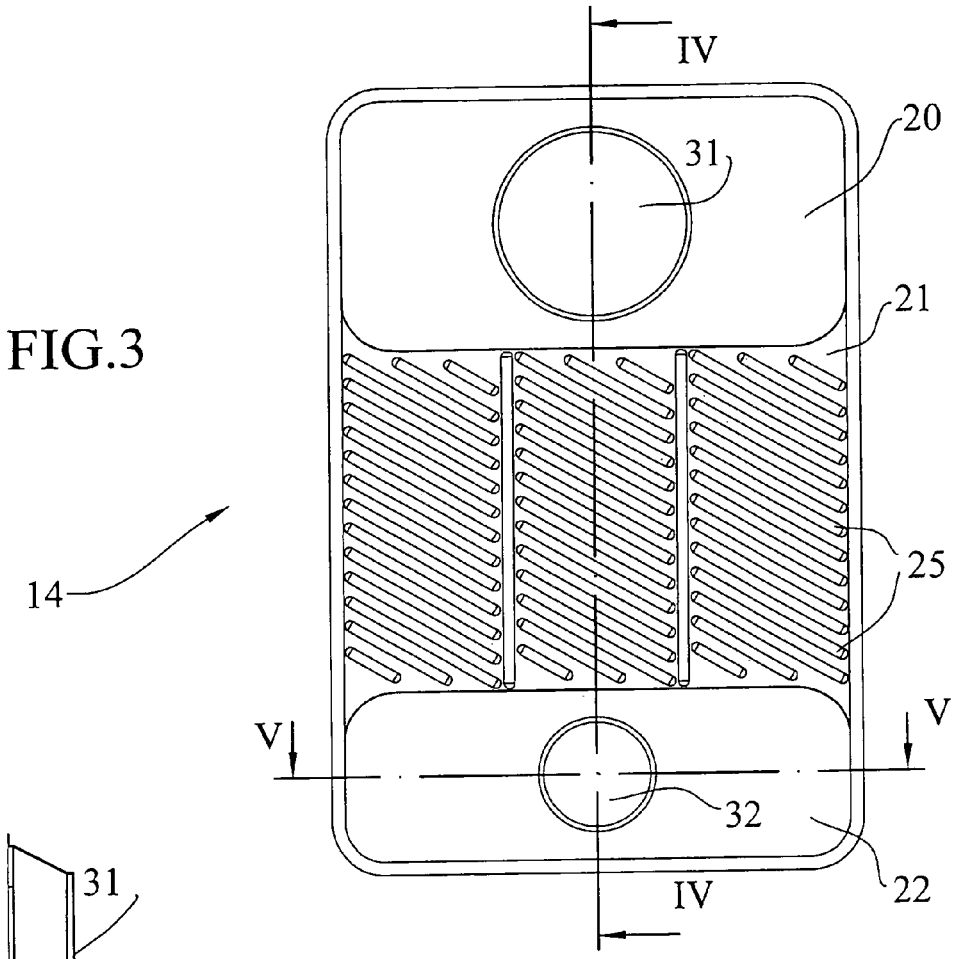
FIG. 3 shows a plan view of a basic element of an exchanger module according to the embodiment of FIG. 2.
Figure 4:
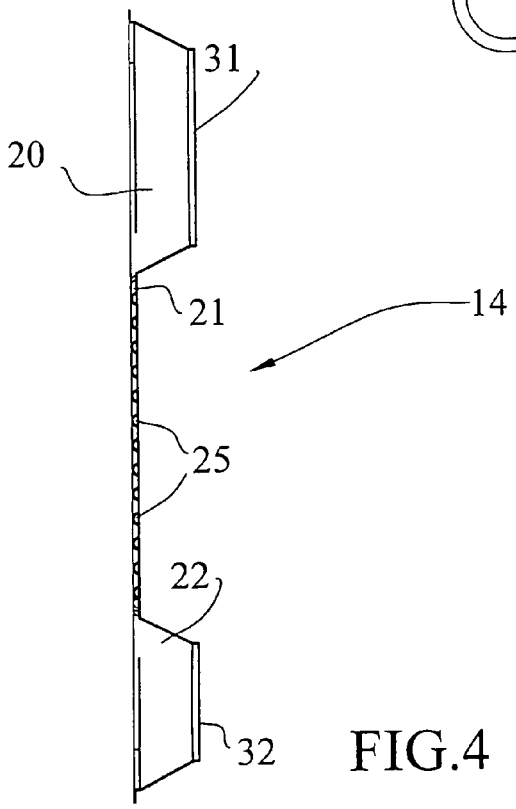
FIG. 4 shows a front section along line IV-IV of the basic element of FIG. 3.
Figure 5:
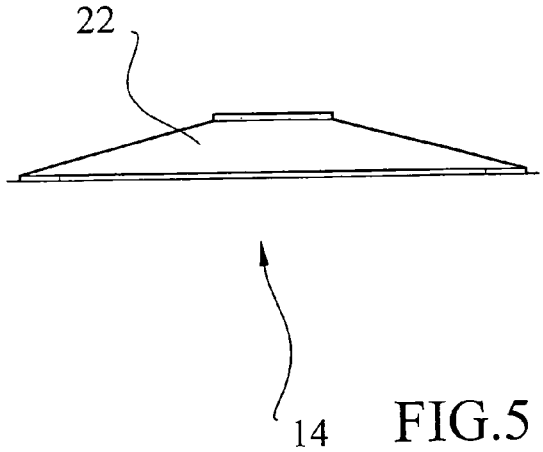
FIG. 5 shows a side section along line V-V of the basic element of FIG. 3.

One of said basic elements 14, made of stainless steel, is shown in FIGS. 3-5. There may be recognized:

- a surface 20, which contributes to combustion chamber 10 where the exchange fluid is generated, having an aperture 31 which is normally shut;
- a surface 21, which contributes to form half of the slotted wall 11, having a plurality of slots 25;
- a surface 22, which contributes to form said expulsion chamber 12 for the exhausted exchange fluid, having an aperture 32, which is normally shut.

Figure 6:
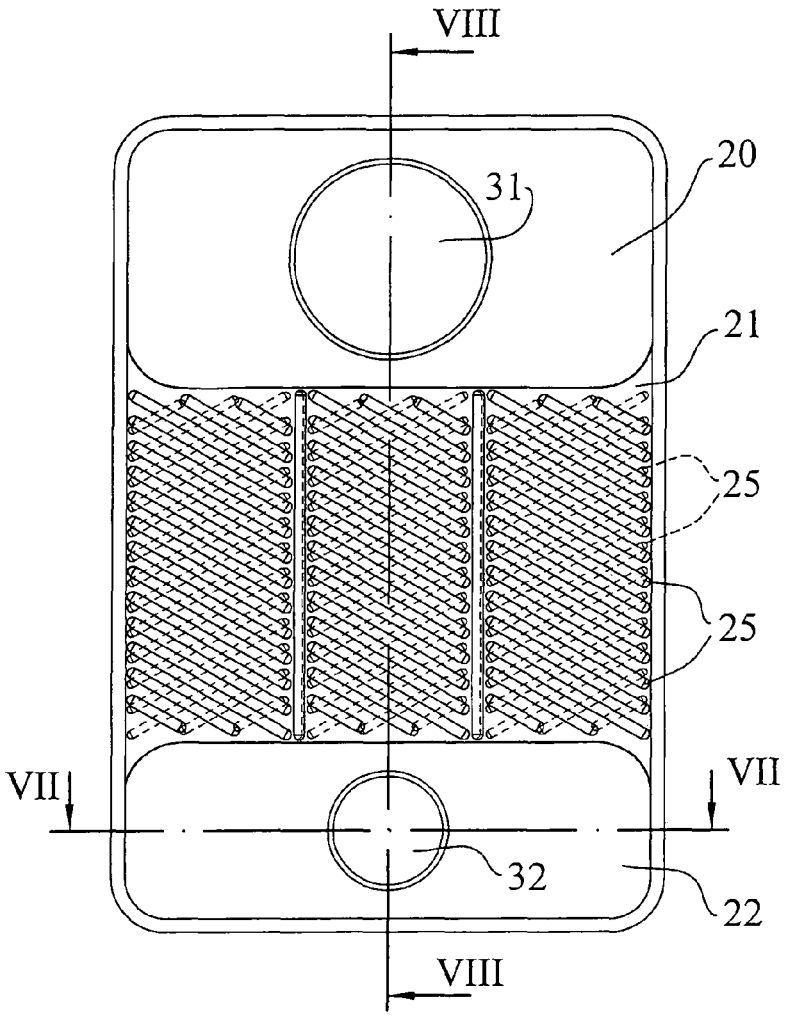
FIG. 6 shows a top view of an exchanger module according to the embodiment of FIG. 2.
Figure 7:
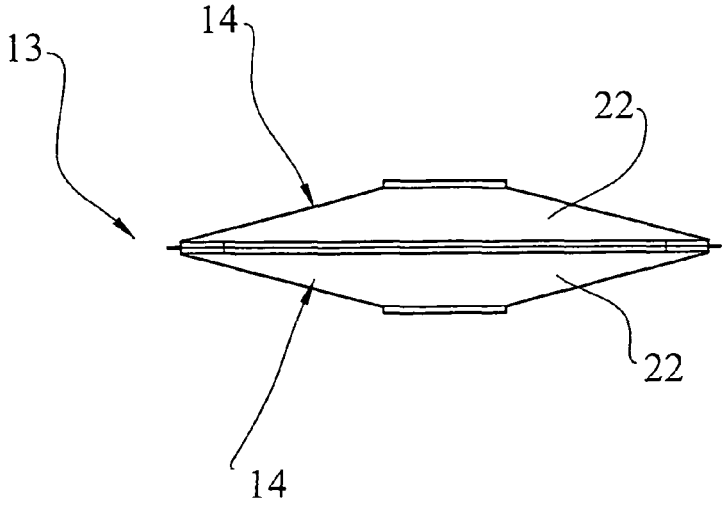
FIG. 7 shows a side section along line VII-VII of the exchanger module of FIG. 6.
Figure 8:
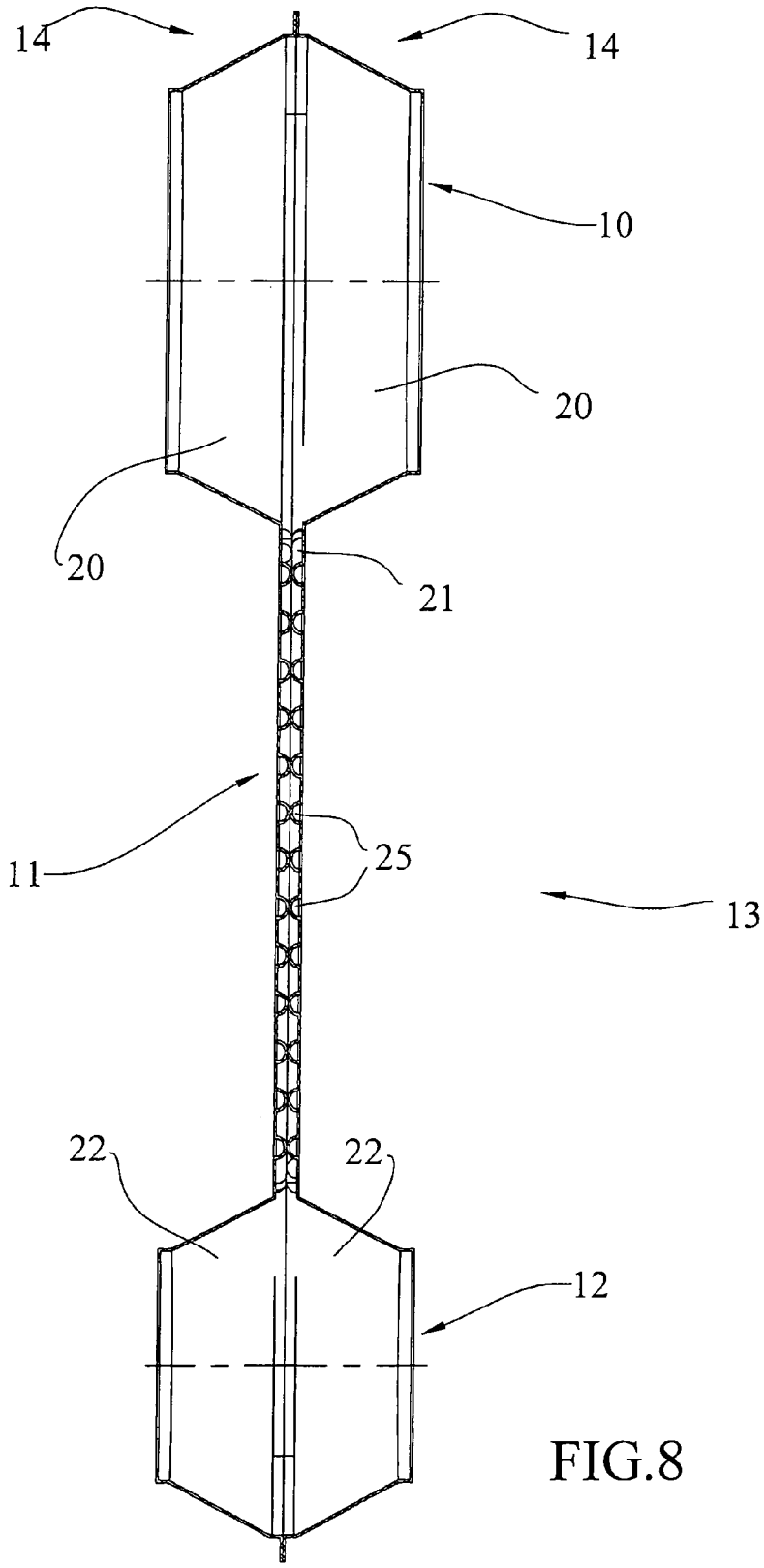
FIG. 8 shows a front section along line VIII-VIII of the exchanger module of FIG. 6.

With reference to FIGS. 6-8, it is possible to observe an exchanger module 13 formed by two basic elements 14. From the comparison of FIG. 4 with FIG. 8 and the comparison of FIG. 7 with FIG. 5, it is possible to understand the construction mechanism of said exchanger module 13 from two basic elements 14, which are reciprocally connected by laser welding, and to appreciate the simplicity of the obtainment of the chambers 10 and 12 and slotted walls 11 are obtained from surfaces 20, 22 and 21. It may also be noted that the construction does not need further connector elements between the parts of said exchanger module 13, which is therefore ready for use.

Figure 9:
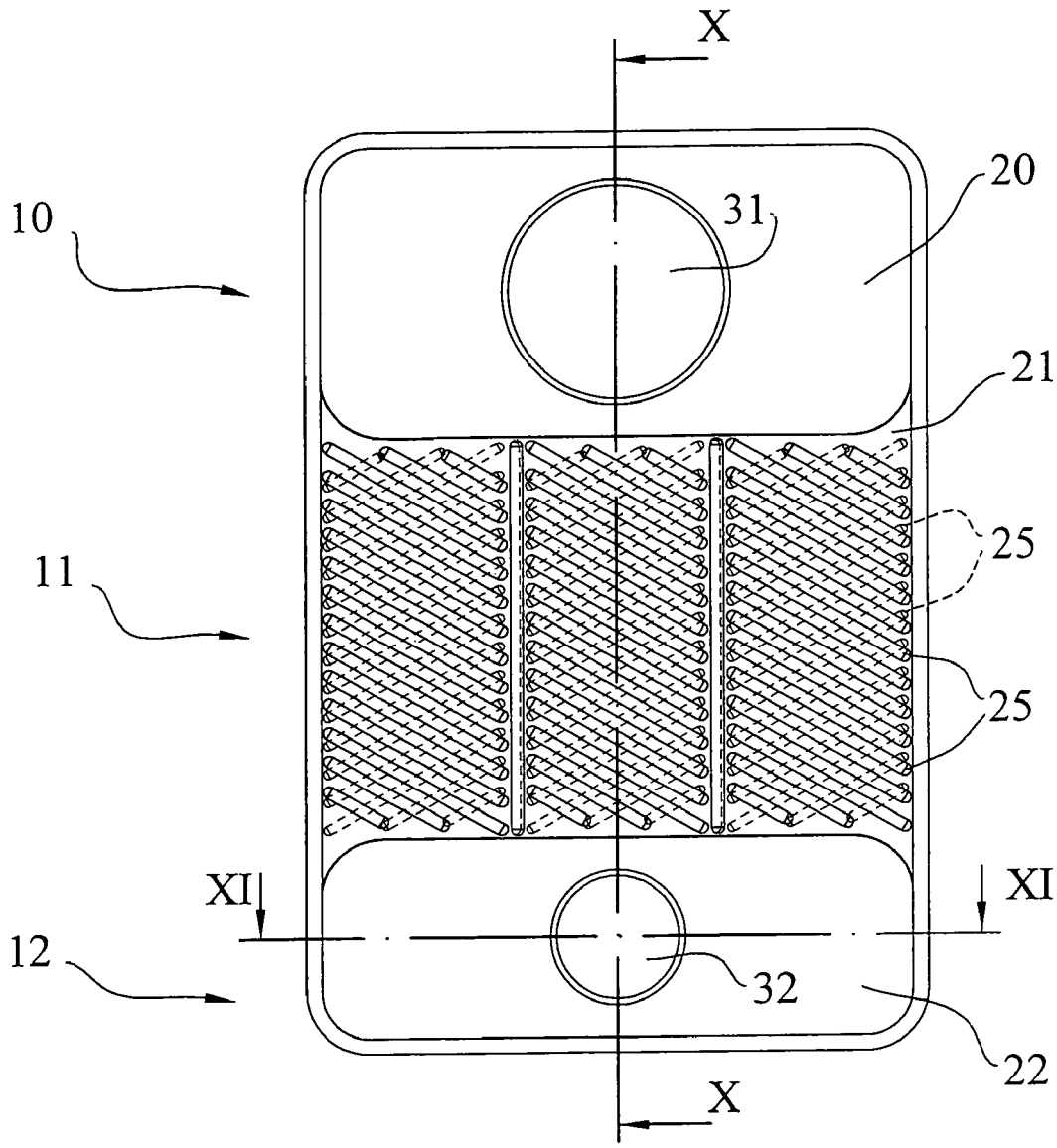
FIG. 9 shows a top view of the exchanger module of FIG. 1.
Figure 10:
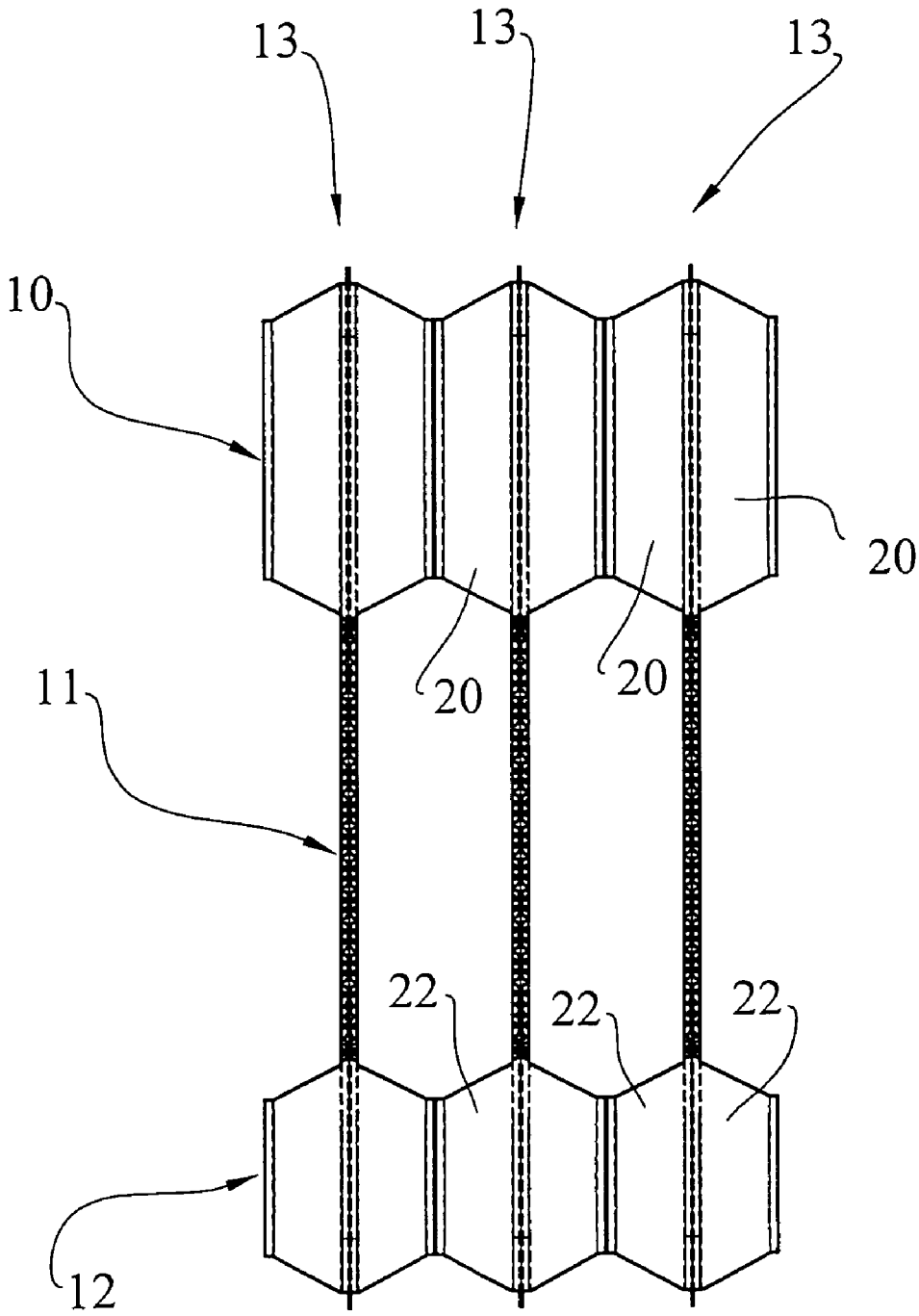
FIG. 10 shows a front section along line X-X of the composite exchanger of FIG. 9.
Figure 11:
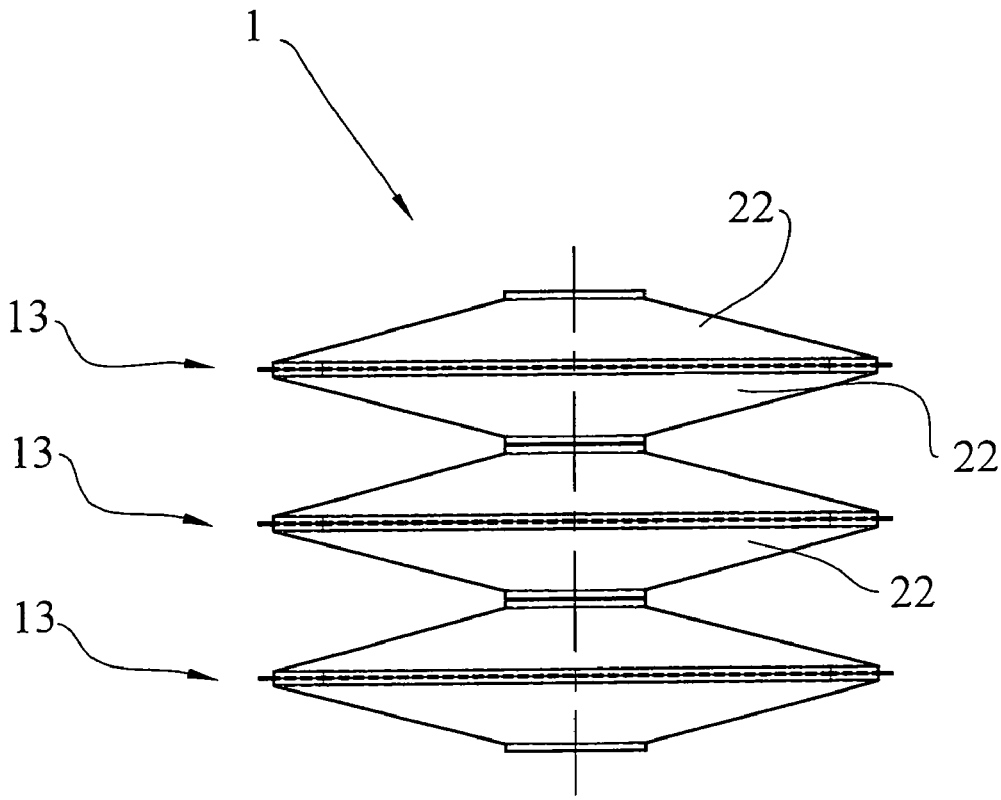
FIG. 11 shows a side section along line XI-XI of the exchanger of FIG. 9.

With reference to FIGS. 9-11, it is possible to observe said heat exchanger 1 formed by three exchanger modules 13. From the comparison of FIG. 11 with FIG. 7 and the comparison of FIG. 8 with FIG. 10, it is possible to understand the assembling mechanism of a heat exchanger 1 from exchanger modules 13, which are reciprocally connected by laser welding. Such an assembly provides the opening of communication apertures 31 and 32 in the coupled basic elements 14.

Figure 12:
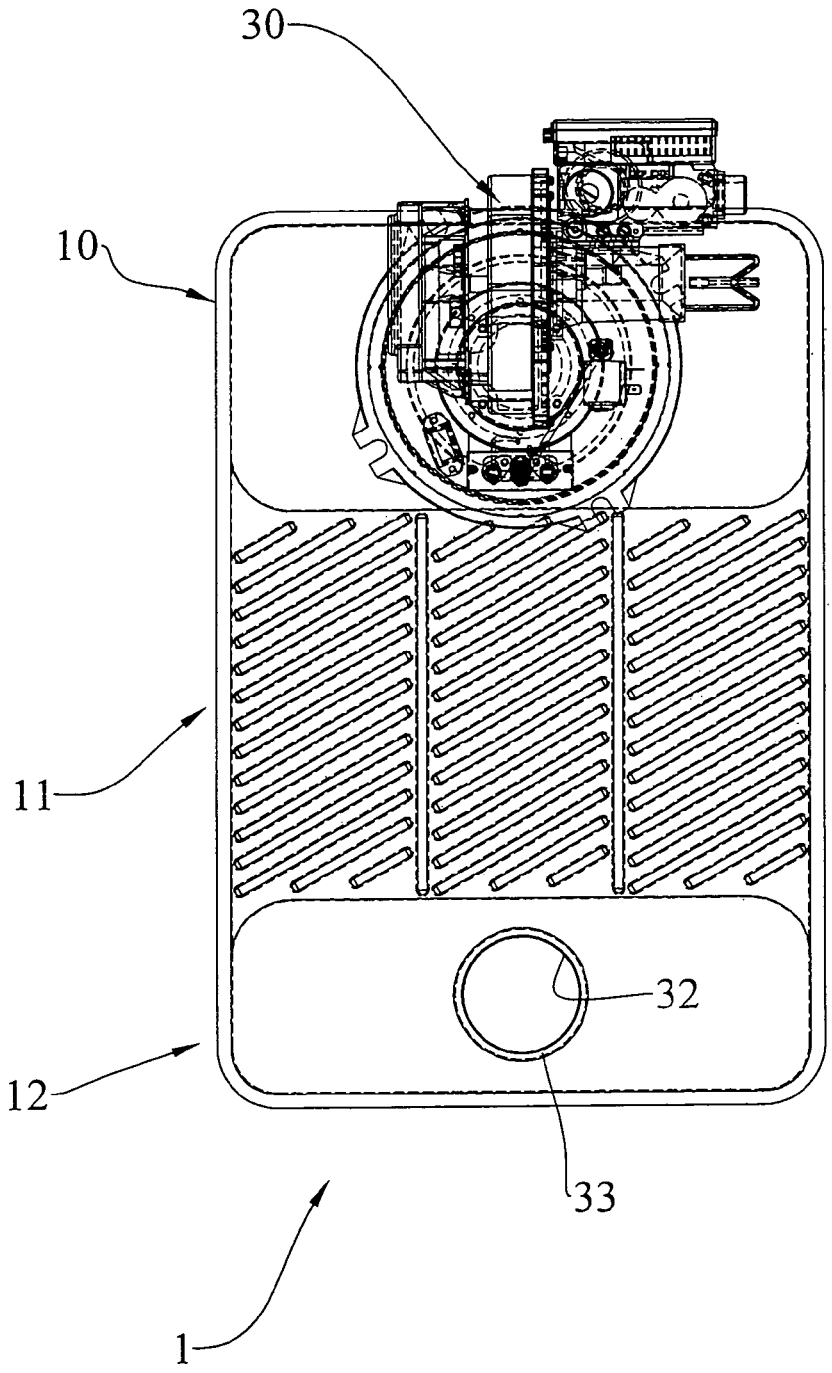
FIG. 12 shows a plan view of the exchanger of FIG. 1 and highlights the connection with a burner.
Figure 13:
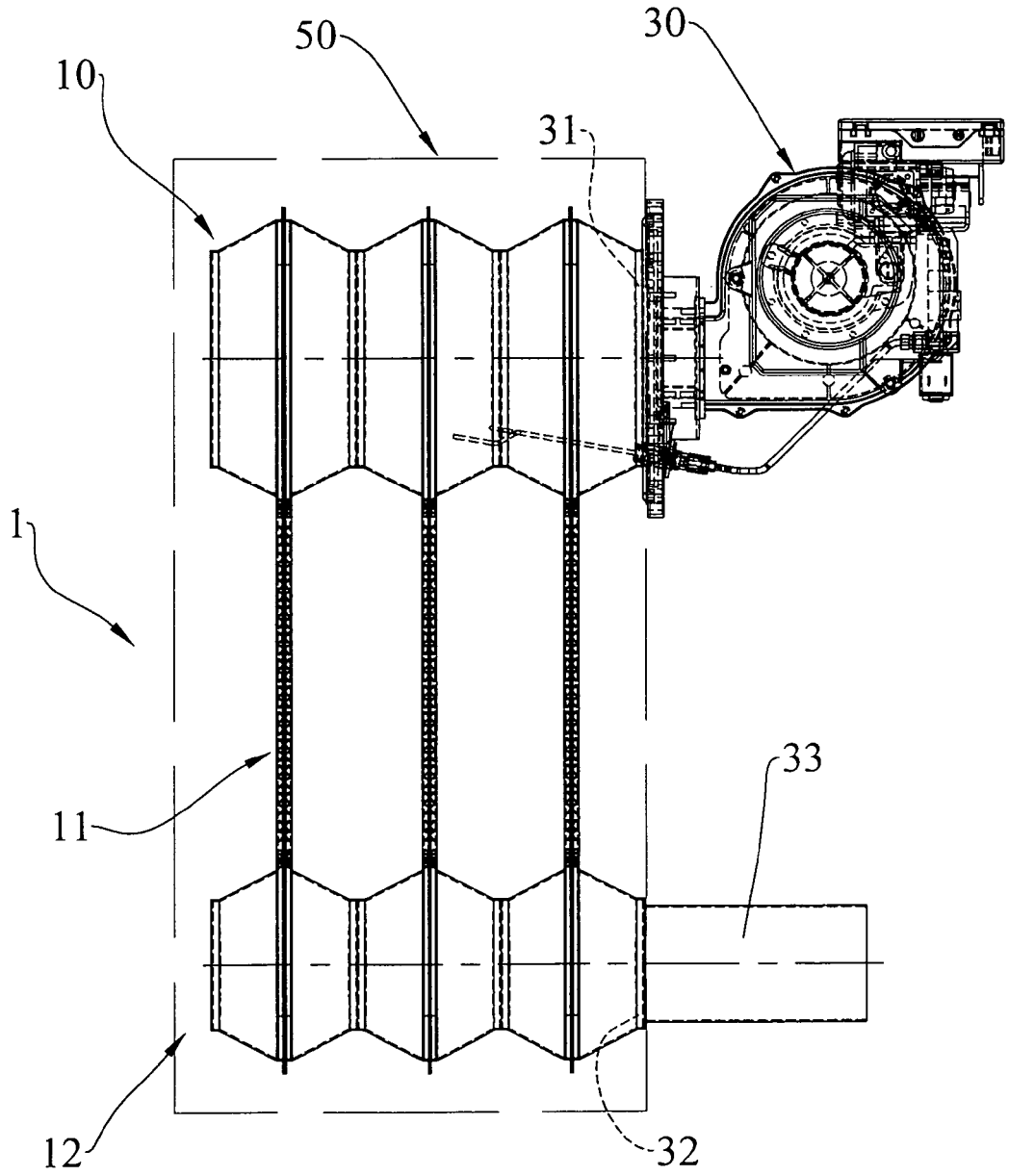
FIG. 13 shows a front view of the exchanger of FIG. 12 and highlights a sealed housing 50 allowing the heating of a liquid.

With reference to FIGS. 12-13, it is possible to observe the same heat exchanger 1 formed by three modular elements 13, in which a burner 30 (not shown in FIGS. 1-11) is highlighted, which is connected to combustion chamber 10 through an aperture 31 that is appropriately opened, and a discharge flue 33 connected to an expulsion chamber 12 at an aperture 32 that is also appropriately opened.

If said heat exchanger is used to heat a liquid, then it may be inserted within an appropriate sealed housing 50 provided with an inlet and an outlet for the liquid.

The invention claimed is:

1. A heat generator comprising a generator module, the generator module including:

a combustion chamber provided with an aperture for connection of a burner for the generation of a heat exchange fluid inside the combustion chamber;

a expulsion chamber provided with an aperture for connection of a discharge flue; and an internally slotted wall for the passage of the exchange fluid from the combustion chamber to the expulsion chamber, wherein the combustion chamber is arranged in a top position and the expulsion chamber is arranged in a bottom position to cause the exchange fluid to run along the internally slotted wall in a descending direction, wherein the generator module is formed by a pair of basic elements, and each of the basic elements forms a part of the combustion chamber, a part of the internally slotted wall, and a part of the expulsion chamber, wherein the basic elements are reciprocally connected in a facing position so as to form a single block, and wherein the internally slotted wall provides winding paths for the exchange fluid, the winding paths being formed by tilted and crossed slots which increase the flow vorticity.

2. A heat generator according to claim 1, wherein the generator module is made of stainless steel.

3. A heat generator according to claim 2, wherein the generator module is disposed within a sealed housing for heating of a liquid contained in the sealed housing.

4. A heat generator according to claim 1, wherein the generator module is disposed within a sealed housing for heating of a liquid contained in the sealed housing.

5. A heat generator according to claim 1, wherein the combustion chamber is larger than the expulsion chamber.

6. A heat generator according to claim 5, wherein the generator module is made of stainless steel.

7. A heat generator according to claim 6, wherein the generator module is disposed within a sealed housing for heating of a liquid contained in the sealed housing.

8. A heat generator according to claim 5, wherein the generator module is disposed within a sealed housing for heating of a liquid contained in the sealed housing.

9. A manufacturing process comprising:

producing a generator module which includes:

a combustion chamber provided with an aperture for connection of a burner for the generation of a heat exchange fluid inside the combustion chamber;

a expulsion chamber provided with an aperture for connection of a discharge flue; and an internally slotted wall for the passage of the exchange fluid from the combustion chamber to the expulsion chamber, wherein the combustion chamber is arranged in a top position and the expulsion chamber is arranged in a bottom position to cause the exchange fluid to run along the internally slotted wall in a descending direction, wherein the generator module is formed by a pair of basic elements, and each of the basic elements forms a part of the combustion chamber, a part of the internally slotted wall, and a part of the expulsion chamber, wherein the basic elements are reciprocally connected in a facing position so as to form a single block, and wherein the internally slotted wall provides winding paths for the exchange fluid, the winding paths being formed by tilted and crossed slots which increase the flow voracity, wherein said producing the generator module includes a first step of forming the basic elements from sheet elements and a second step of connecting the basic elements to form the generator module; and performing a third step of assembling a plurality of generator modules to form a heat generator.

10. A process according to claim 9, wherein said first step comprises the mechanical deformation of stainless steel sheet elements.

11. A process according to claim 10, wherein said second step includes laser welding of the basic elements.

12. A process according to claim 10, wherein said third step includes laser welding of the generator modules.

13. A process according to claim 10, wherein said first step includes forming an aperture for the application of a burner and forming a further aperture for the application of a discharge flue.

14. A process according to claim 9, wherein said second step includes laser welding of the basic elements.

15. A process according to claim 14, wherein said third step includes laser welding of the generator modules.

16. A process according to claim 14, wherein said first step includes forming an aperture for the application of a burner and forming a further aperture for the application of a discharge flue.

17. A process according to claim 9, wherein said third step includes laser welding of the generator modules.

18. A process according to claim 9, wherein said first step includes forming an aperture for the application of a burner and forming a further aperture for the application of a discharge flue.

* * * * *

UNITED STATES PATENT AND TRADEMARK OFFICE

CERTIFICATE OF CORRECTION

PATENT NO. : 8,091,515 B2
APPLICATION NO. : 12/223922
DATED : January 10, 2012
INVENTOR(S) : Angelo Rigamonti It is certified that error appears in the above-identified patent and that said Letters Patent is hereby corrected as shown below:

On the Title page of the patent, list the Foreign Application Priority Data. The Title page should read:

-- (30) Foreign Application Priority Data

February 15, 2006 (Italy) .....MI2006 A 000274 --

Signed and Sealed this
Twenty-seventh Day of March, 2012

David J. Kappos

David J. Kappos
*Director of the United States Patent and Trademark Office*